US005433387A

United States Patent [19]

Howe et al.

[11] Patent Number: 5,433,387

[45] Date of Patent: Jul. 18, 1995

[54] NONINCENDIVE ROTARY ATOMIZER

[75] Inventors: Varce E. Howe, Zionsville; David R. Huff; James A. Scharfenberger, both of Indianapolis, all of Ind.; Jeffrey M. Stupar, West Dundee, Ill.

[73] Assignee: Ransburg Corporation, Indianapolis, Ind.

[21] Appl. No.: 985,613

[22] Filed: Dec. 3, 1992

[51] Int. Cl.[6] ..... B05B 5/04; B05B 5/053

[52] U.S. Cl. ..... 239/703; 239/690; 239/700; 239/DIG. 19; 118/629

[58] Field of Search ..... 239/690, 697, 698, 699, 239/700, 701, 702, 703, 708, DIG. 19; 118/620, 621, 629

[56] References Cited

U.S. PATENT DOCUMENTS

| | | | |
|---|---|---|---|
| 2,728,607 | 12/1955 | Smart | 239/703 X |
| 2,926,106 | 2/1960 | Gauthier . | |
| 2,989,241 | 6/1961 | Badger . | |
| 3,021,077 | 2/1962 | Gauthier . | |
| 3,048,498 | 8/1962 | Juvinall et al. . | |
| 3,055,592 | 9/1962 | Probst . | |
| 3,826,425 | 7/1974 | Scharfenberger et al. . | |
| 3,900,000 | 8/1975 | Gallen | 239/703 X |
| 4,148,932 | 4/1979 | Tada et al. . | |
| 4,485,427 | 11/1984 | Woodruff et al. . | |
| 4,589,597 | 5/1986 | Robisch et al. | 239/703 |
| 4,745,520 | 5/1988 | Hughey . | |
| 4,887,770 | 12/1989 | Wacker et al. . | |
| 4,896,834 | 1/1990 | Coeling et al. | 239/704 X |
| 4,919,333 | 4/1990 | Weinstein | 239/703 X |
| 4,943,005 | 7/1990 | Weinstein | 239/703 X |
| 5,078,321 | 1/1992 | Davis et al. | 239/703 X |
| 5,137,215 | 8/1992 | Degli | 239/703 X |

OTHER PUBLICATIONS

Cekis, G. V. "Polyamide-imide." in: Modern Plastics Cncyclopedia (1981-1982 ed.), p. 42.

M. Kanatzidis, "Conductive Polymers," Chemical and Engineering News, Dec. 3, 1990, pp. 36-54.

*Primary Examiner*—William Grant

*Attorney, Agent, or Firm*—Barnes & Thornburg

[57] ABSTRACT

A rotary atomizer includes an inside surface onto which a coating material is deposited, an opposite outside surface and a discharge zone adjacent the rotary atomizer's inside and outside surfaces, coating material being discharged from the discharge zone. A housing substantially surrounds and houses the rotary atomizer except for a region of the rotary atomizer adjacent and including the discharge zone. The housing includes an inside surface, an outside surface and an opening adjacent the inside and outside surfaces of the housing. The inside surface of the housing and the outside surface of the rotary atomizer are treated so as to render them electrically non-insulative. An electrostatic potential difference maintained across the electrically non-insulative inside surface of the housing and an article to be coated by material atomized by the rotary atomizer causes charge to be transferred from the electrically non-insulative inside surface of the housing to the outside surface of the atomizer.

23 Claims, 7 Drawing Sheets

NONINCENDIVE ROTARY ATOMIZER

This invention relates to electrostatic coating methods and apparatus.

Insurance carriers increasingly require factories in which electrostatically aided coating operations are being conducted to comply with National Fire Protection Association (NFPA) regulations governing finishing processes. NFPA regulations distinguish between agency (usually Factory Mutual—FM) approved, or listed (resin or filled resin construction and resistive electrostatic power supply circuit), coating material dispensers, on the one hand, and unapproved (metal construction and often "stiff" electrostatic power supply circuit) coating material dispensers on the other. Bell-type applicators which utilize resinous materials in their construction and resistive electrostatic power supply circuits are known. See, for example, U.S. Pat. No. 4,887,770. Devices of the general type described in U.S. Pat. No. 4,887,770 achieve whatever safety they achieve at the sacrifice of transfer efficiency and flexibility in the types of coating materials that they can dispense.

The present invention contemplates providing a superior coating material dispensing system by providing: a stable semiconductive bell; reduced use of metal, and thus, reduced capacitance; and, constant voltage output cascade and control technology. The combination of these features results in an applicator capable of achieving agency approval, capable of superior transfer efficiency, and capable of dispensing a wider variety of coating materials.

According to a first aspect of the invention, unique methods are provided for producing the proper combination of resistance and capacitance in a bell. These methods are capable of the same high performance as grooved metal bells of the type described in, for example U.S. Pat. No. 4,148,932.

According to a second aspect of the invention, a high voltage circuit is provided which incorporates state-of-the-art cascade power supply technology, and uses relatively low fixed resistance between the electrostatic power supply output and bell. This ensures high operating voltage and performance superior to, for example, U.S. Pat. No. 4,887,770's resinous bell (see FIG. 1), and hand guns of the type described in, for example, U.S. Pat. Nos. 3,021,077, 2,926,106, 2,989,241, 3,055,592 and 3,048,498. The voltage/current "operating window" is based on typical operating characteristics for electrostatic applicators of this type, and competitive metal bell devices. Such devices have been tested and typically found to operate in this voltage/current range. This operating window can be used to predict transfer efficiency.

According to a third aspect of the invention, a bell rotator assembly is provided which is constructed mostly of resinous materials.

According to the first aspect of the invention, a resin or filled resin bell is coated on its outer surface with a semiconductive coating, which may be one or a combination of: thin, for example, less than 200 Å, film metallic coatings applied by vacuum metallization, sputtering or similar processes; a combination of resistive and conductive media such as silicon and stainless steel deposited by vacuum metallization, fluidized bed deposition, spray or any of several like methods; a combination of resistive and conductive materials dispersed in a liquid carrier, such as carbon particles suspended in a varnish, and deposited on the bell surface by dipping, spraying or any of several like application methods; and, irradiation of the bell surface by electron beam or any of several like methods to cause a change in the bell's surface resistance.

Further according to the first aspect of the invention, the high voltage is conducted onto the bell's surface without physical contact to the rotating bell. This non-contact, or commutator, charging can be, for example, a single or multiple wire electrodes which have limited capacitance; a wire ring which surrounds the neck region of the bell remote from the bell's discharge edge; a semiconductive coating on the inner surface of the shaping air ring which surrounds the region of the bell out as far as the front edge of the bell, or other similar means. This non-contact, commutator charging aspect not only efficiently couples the high voltage to the bell outer surface, but it also serves as a buffer to reduce the likelihood that the typically metal bell rotator shaft will be the source of a hazardous spark in the event the resinous bell is not in place, such as when the bell has been removed for cleaning or other maintenance, or for replacement.

Further according to the second aspect of the invention, cascade power supply technology is used in combination with limited fixed resistance, for example, less than 500 MΩ, to reduce high voltage degradation among the cascade power supply output, the commutator circuit and the bell edge. Limiting the effective capacitance of the bell rotator motor is achieved by surrounding the motor with resinous materials and permitting the motor potential with respect to ground or some other reference to float, or by coupling the motor to ground or some other reference potential through a bleed resistor. Alternatively, the motor can be coupled to the cascade output, and the electronic circuitry employed in combination with fixed resistance and the semiconductive bell surface treatment to limit the discharge to a safe level. This aspect of the invention also contemplates an improvement in the control of the energy stored in the metal bell rotator motor to a sufficiently low level that the likelihood of hazardous electrical discharge from the motor shaft will be minimized even in the event that the bell cup is not in place when the high-magnitude voltage supply is energized. The energy W stored in a capacitor can be expressed as $$W = \frac{CV^2}{2} \tag{1}$$

where C=capacitance of the capacitor, and V=voltage across the capacitor. Stored energy in a bell-type coating material atomizer is directly related to the area of the conductive or semiconductive material on the bell surface. Other factors also contribute to the release of energy stored in the bell's capacitance. These include: resistance, which limits the rate of energy discharge; the geometry of the bell and the article to which coating material dispensed from the bell edge is to be applied; any surface charge on the exposed, uncoated resinous material from which the bell is constructed; and, the distribution of the energy being discharged, that is, the number of discharge or corona points. It is noted that current flowing from the bell at steady state conditions has no effect on the amount of energy stored in the bell's capacitance.

In summary, according to the invention the capacitance of the dispensing bell, its rotator and associated components is kept as low as possible, and the bell resistance is kept as low as possible to limit the power dissipation of the bell. The geometries of the coating dispensing bell and associated components are optimized for discharge. The surface charging characteristics of the bell are optimized. Sufficient total system resistance is provided to limit the energy discharge. And, the method of transferring voltage to the bell is optimized. The ideal load curve, FIG. 2, based on these considerations results in a straight horizontal line at the maximum non-incendive voltage throughout the operating current range. Resistance between the cascade-type power supply and bell degrades the performance of power supply safety circuits such as those found in power supplies of the types described in, for example, U.S. Pat. Nos. 4,485,427 and 4,745,520. See FIG. 3. Consequently, a compromise may be required to be made between cost and performance.

According to one aspect of the invention, a rotary atomizer comprises an inside surface onto which a coating material, such as a liquid or a powder, is deposited, an opposite outside surface and a discharge zone adjacent the rotary atomizer's inside and outside surfaces. The coating material is discharged from the discharge zone. First means are provided for rotating the rotary atomizer. A housing substantially surrounds and houses the rotary atomizer except for a region of the rotary atomizer adjacent and including the discharge zone. The housing includes an inside surface, an outside surface and an opening adjacent the inside and outside surfaces of the housing. The inside surface of the housing and the outside surface of the rotary atomizer are both treated so as to be electrically non-insulative. Second means are provided for maintaining an electrostatic potential difference across the electrically non-insulative inside surface of the housing and an article to be coated by material atomized by the rotary atomizer.

Illustratively, the second means comprises a high-magnitude potential source. Third means are provided for coupling the high-magnitude potential source across the inside surface of the housing and the article to be coated. According to the illustrative embodiment, the third means has a resistance less than or equal to 500 MΩ. According to another illustrative embodiment, the third means has a resistance less than 250 MΩ. According to yet another embodiment, the resistance between the second means and the discharge zone is less than or equal to 500 MΩ. According to yet another embodiment, the resistance between the second means and the discharge zone is less than or equal to 250 MΩ.

According to another aspect of the invention, a rotary atomizer includes an interior surface across which the coating material moves as a result of rotation of the rotary atomizer, and a shaft receiving region for receiving the shaft of a motor for rotating the rotary atomizer. The shaft provides a passageway through which the coating material is supplied to the interior surface of the rotary atomizer. A barrier is provided on the rotary atomizer between the passageway and the shaft for increasing the distance from the surface of the shaft to the interior surface.

Illustratively, according to this aspect of the invention, the shaft is electrically non-insulative. The rotary atomizer further comprises an exterior surface and a zone from which the coating material is discharged. The discharge zone lies adjacent the interior and exterior surfaces. The exterior surface is treated so as to render the exterior surface non-insulative. Means are provided for maintaining a high-magnitude electrostatic potential difference across the exterior surface and an article to be coated.

According to illustrative embodiments of the invention, the treatment comprises a non-insulative coating applied to the inside surface of the housing and the outside surface of the rotary atomizer. According to an illustrative embodiment, the non-insulative coating comprises non-insulative particles in a resin matrix. According to another illustrative embodiment, the non-insulative coating comprises a metallic film. According to yet another embodiment, the non-insulative coating comprises a film mixture of a semiconductor and a metal.

According to an illustrative embodiment, the treatment comprises irradiating or otherwise treating the inside surface of the housing and the outside surface of the rotary atomizer to render them electrically non-insulative.

According to illustrative embodiments, the rotary atomizer and the housing are constructed from electrically non-conductive resinous materials. According to an illustrative embodiment, the rotary atomizer is constructed from filled or unfilled polyetheretherketone (PEEK). According to another illustrative embodiment, the rotary atomizer is constructed from filled or unfilled polyetherimide (PEI). According to the another illustrative embodiment, the rotary atomizer is constructed from filled or unfilled polyester, such as, for example, polybutylene terephthalate (PBT). According to another illustrative embodiment, the rotary atomizer is constructed from filled or unfilled polyamide-imide (PAI).

The invention may best be understood by referring to the following description and accompanying drawings which illustrate the invention. In the drawings.

Figure 7:
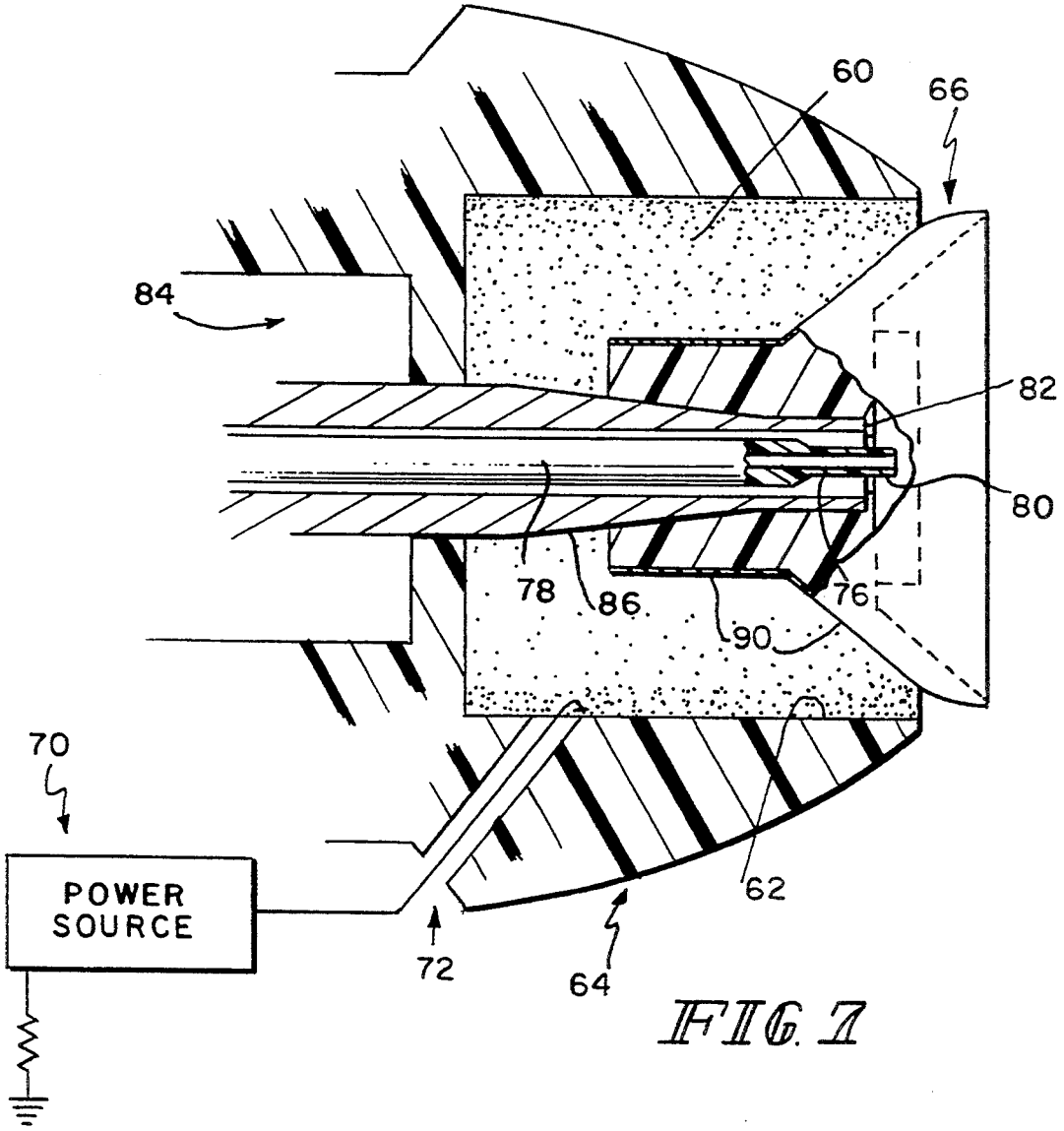
FIG. 7 illustrates a fragmentary axial sectional view of a system constructed according to the present invention.
Figure 8B:
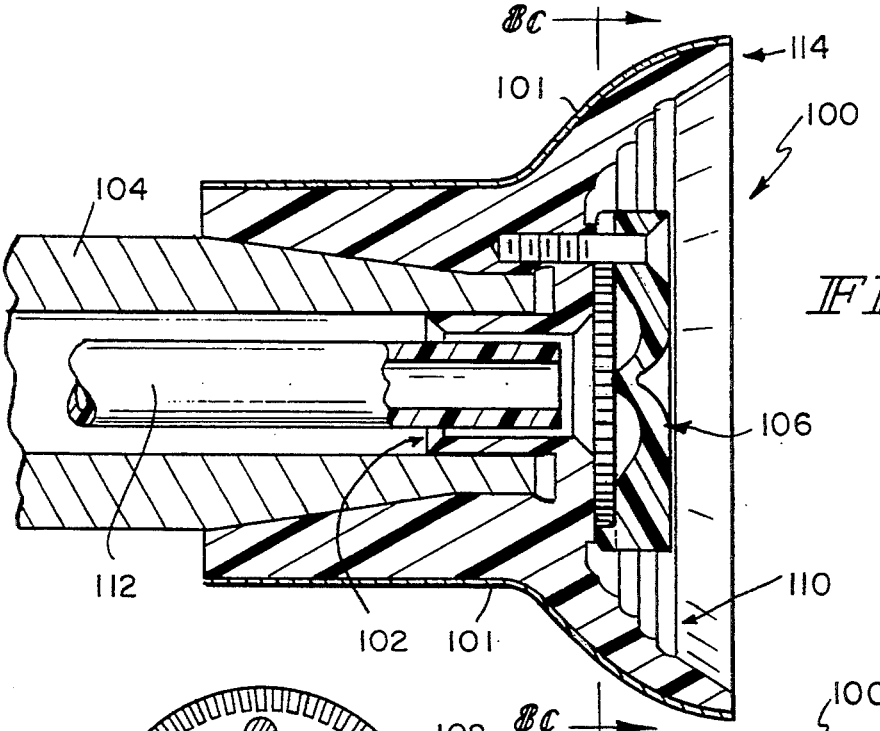
Figure 8C:
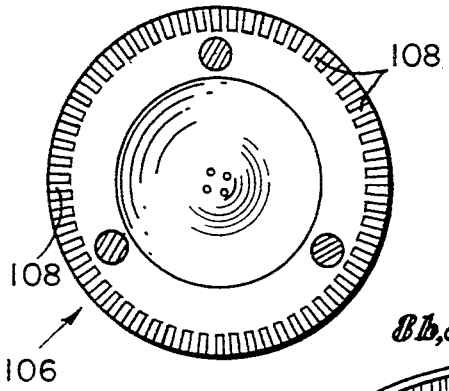
Figure 8D:
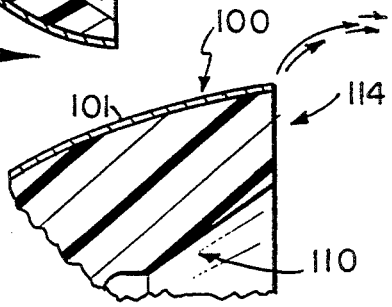
Figure 8A:
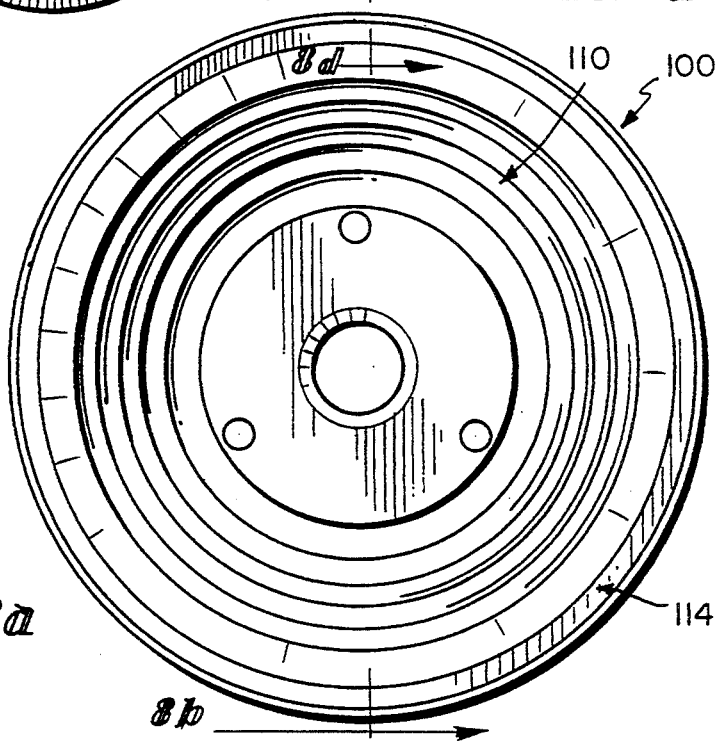
Figure 9:
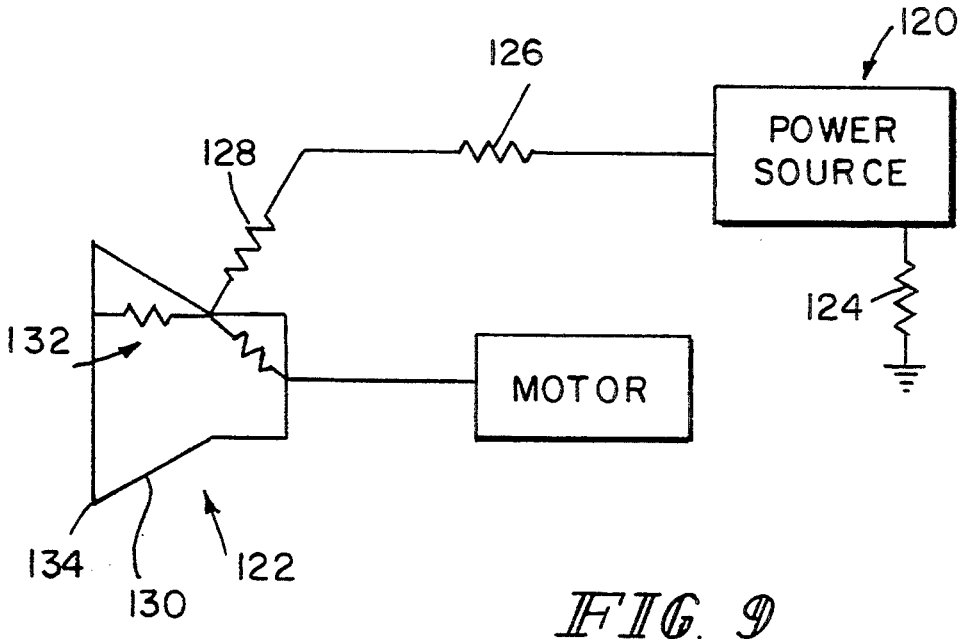

FIGS. 8*a–d* illustrate several views of a detail of the system illustrated in FIG. 7; and, FIG. 9 illustrates a partly block and partly schematic diagram of a system constructed according to the present invention.

In the following examples, the Rans-Pak 100 power supply available from Ransburg Corporation, 3939 West 56th Street, Indianapolis, Ind. 46254-1597 was used as the high-magnitude potential source. The bell rotator motor and other metal components were provided with a bleed path to ground either through the cascade power supply's 5 GΩ bleeder resistor or through another auxiliary resistor connected to ground. The power supply's current overload was adjusted to the least sensitive setting. A resinous bell of the general configuration described in U.S. Pat. No. 4,148,932 and coated with carbon coating of the general type described in U.S. Pat. No. 3,021,077 was used. The configurations were tested with and without the bell installed. A Ransburg type 18100 high-magnitude potential supply was used as a stiff, more capacitive source to determine to what extent non-incendive characteristics determined during testing were attributable to series resistance rather than to the foldback and safety diagnostics of the Rans-Pak 100 power supply.

EXAMPLE I

Indirect Charging With Commutating Point

Figure 1:
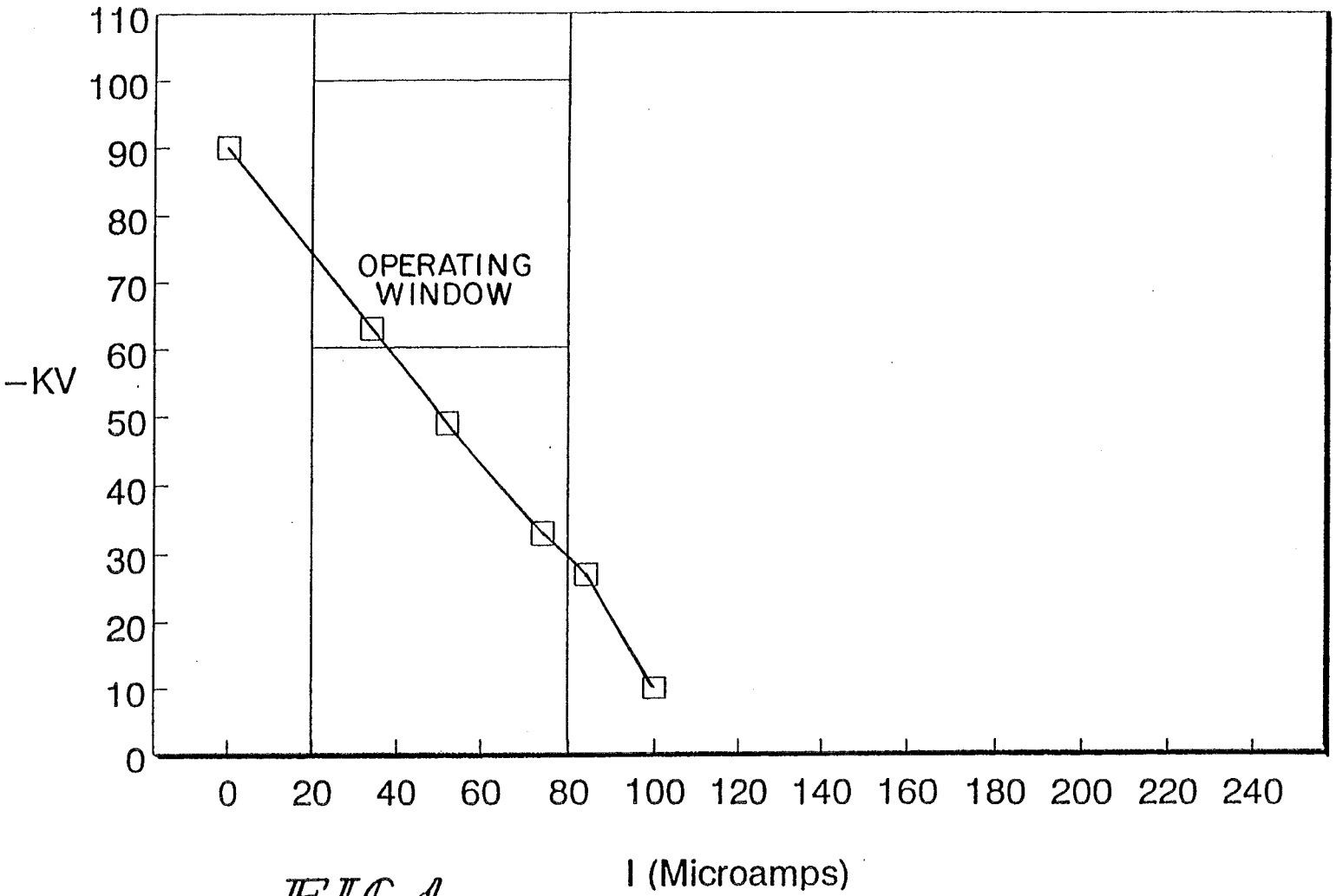
FIG. 1 illustrates an electrostatic potential supply output voltage versus output current characteristic of a prior art rotary atomizer.
Figure 2:
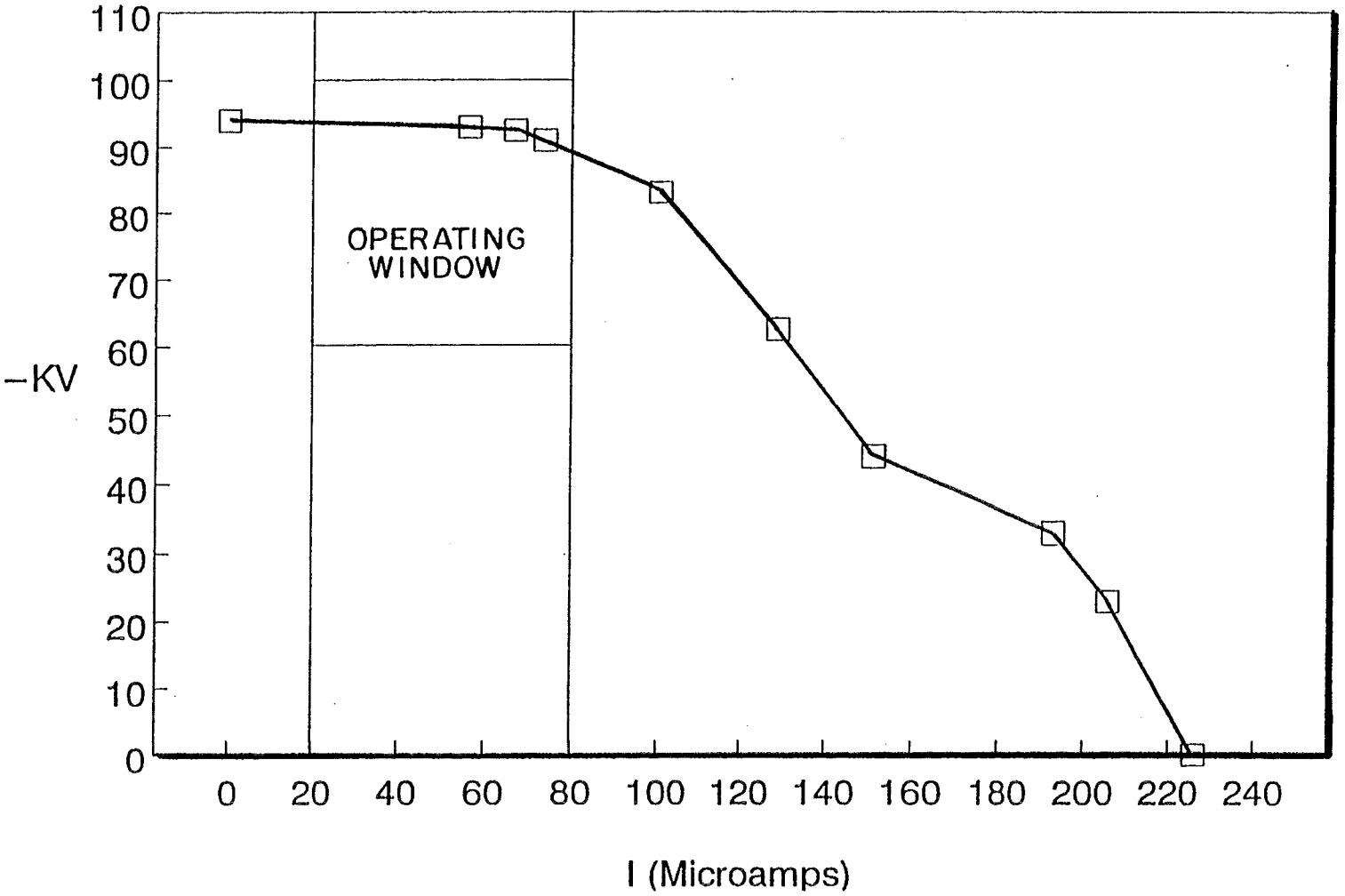
FIG. 2 illustrates an electrostatic potential supply output voltage versus output current characteristic of the rotary atomizer of the present invention.
Figure 3:
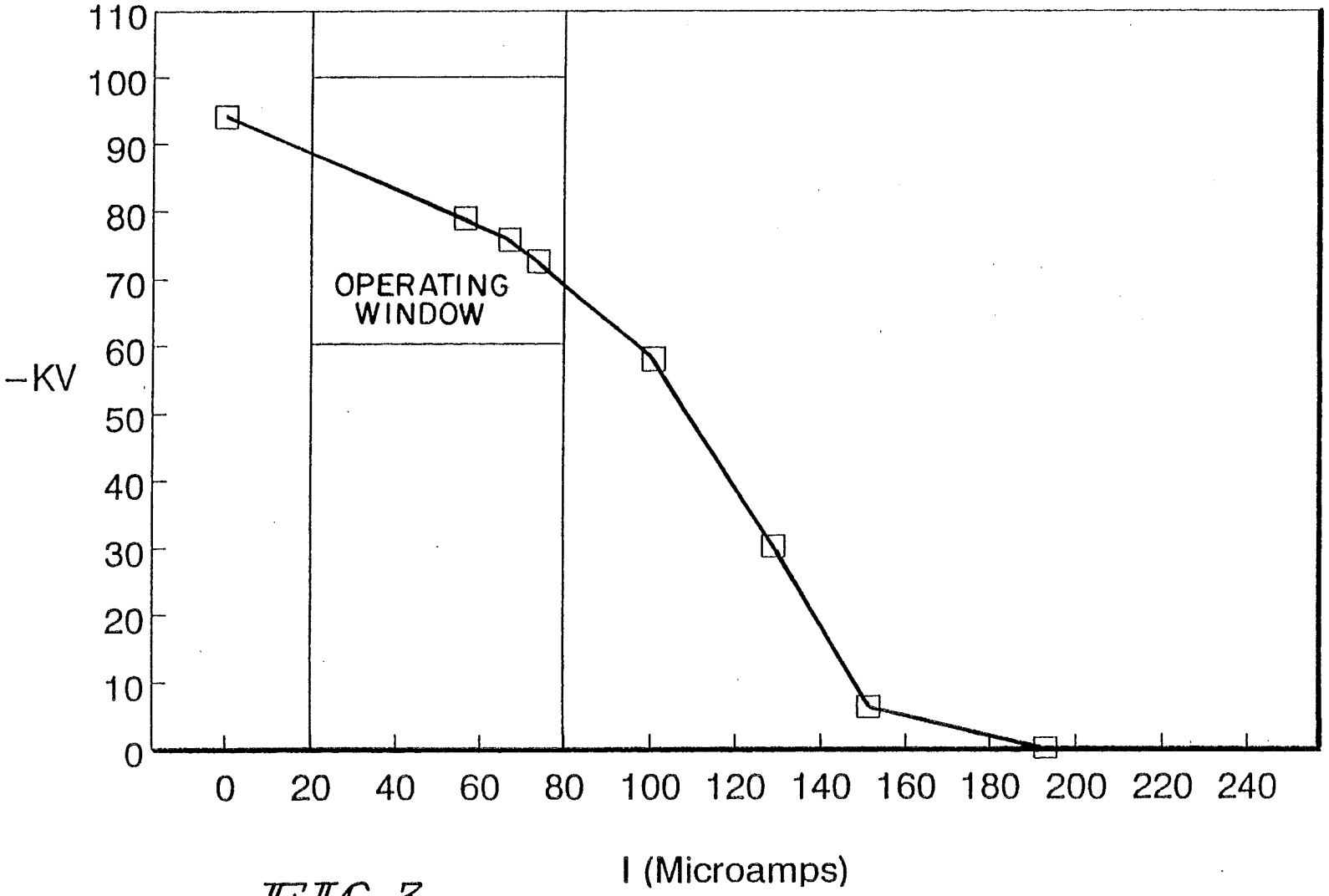
FIG. 3 illustrates an electrostatic potential supply output voltage versus output current characteristic of the rotary atomizer of the present invention.
Figure 4:
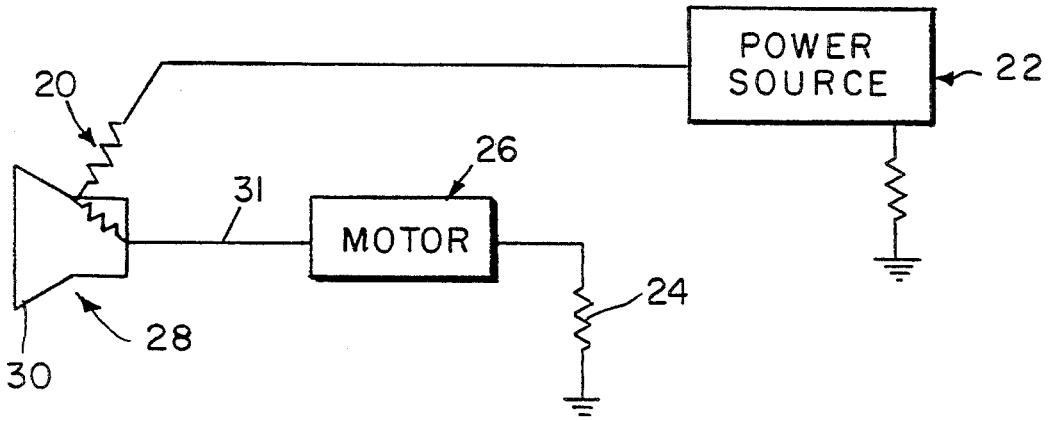
FIG. 4 illustrates a partly block and partly schematic diagram of a system constructed according to the present invention.

The configuration illustrated in FIG. 4 was constructed and tested with the variables noted in Table I.

TABLE I

| POWER SOURCE | $R_{20}$ | $R_{24}$ | DISPLAYED I(μA) | REQUESTED KV | ENERGY DISCHARGE |
|---|---|---|---|---|---|
| Rans-Pak 100 | 250MΩ | 5GΩ | 60 | 100 | GOOD |
| Rans-Pak 100 | 150MΩ | 5GΩ | 100 | 100 | GOOD |
| Rans-Pak 100 | 20MΩ | 5GΩ | 140 | 100 | GOOD |
| Rans-Pak 100 | 250MΩ | ∞ | 40 | 100 | GOOD |
| 18100 | 250MΩ | ∞ | — | 100 | GOOD |
| 18100 | 150MΩ | ∞ | — | 100 | TOO SUSCEPTIBLE TO ARCING |

It was noted that the combination of 250 MΩ located directly behind the single point electrode supplied sufficient protection independent of the Rans-Pak system safety diagnostics. Any resistor 20 value below 250 MΩ required the Rans-Pak electrostatic power supply 22's slope detection and overcurrent diagnostics to assure non-incendive operation. The 5 GΩ motor bleed resistor 24 functioned satisfactorily. A higher resistance of 10 GΩ or 20 GΩ could also supply sufficient discharge characteristics while limiting the electrostatic power supply 22's current draw. The potential difference existing between the motor 26 and the bell 28 edge 30 through the metal motor shaft 31 was approximately 5 KV in the configuration of FIG. 4, which did not present a problem.

EXAMPLE II

Indirect Charging With Commutating Point

Figure 5:
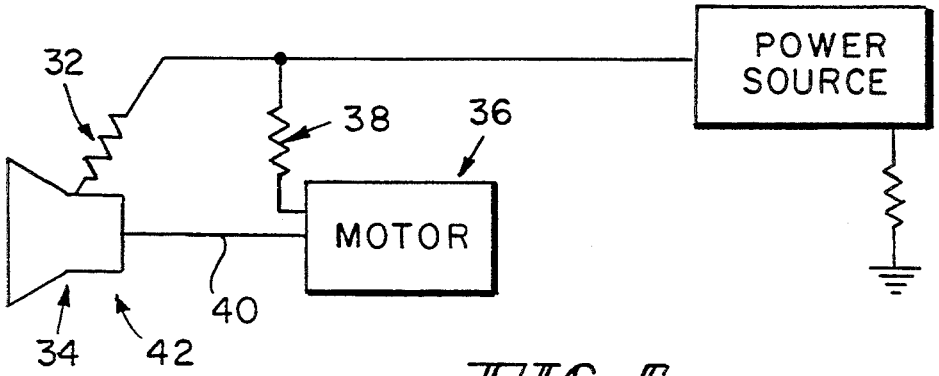
FIG. 5 illustrates a partly block and partly schematic diagram of a system constructed according to the present invention.

The configuration illustrated in FIG. 5 was constructed and tested with the variables noted in Table II.

TABLE II

| POWER SOURCE | $R_{32}$ | $R_{38}$ | REQUESTED KV | ENERGY DISCHARGE (Bell Attached) | COMMENTS |
|---|---|---|---|---|---|
| Rans-Pak 100 | 120MΩ | 120MΩ | 100 | GOOD | |
| 18100 | 120MΩ | 120MΩ | 100 | ARCING | VERY SUSCEPTIBLE TO ARCING |
| Rans-Pak 100 | 50MΩ | 120MΩ | 100 | NONE | RP100 TRIPS EASILY |
| Rans-Pak 100 | 250MΩ | 120MΩ | 100 | NONE | RP100 TRIPS PREMATURELY |
| Rans-Pak 100 | 250MΩ | 3MΩ | 100 | GOOD | |
| Rans-Pak 100 | 250MΩ | 0Ω | 100 | GOOD | |

It was noted that the resistor 32 located directly behind the bell 34 determines the system characteristics and that the motor 36 resistance 38 is not as critical and can even be 0 Ω. The length of the resinous motor shaft 40 was sufficient to prevent arcing caused by the voltage drop of resistor 32 to the rear 42 of the bell 34.

EXAMPLE III

Direct Charging With Commutating Point

Figure 6:
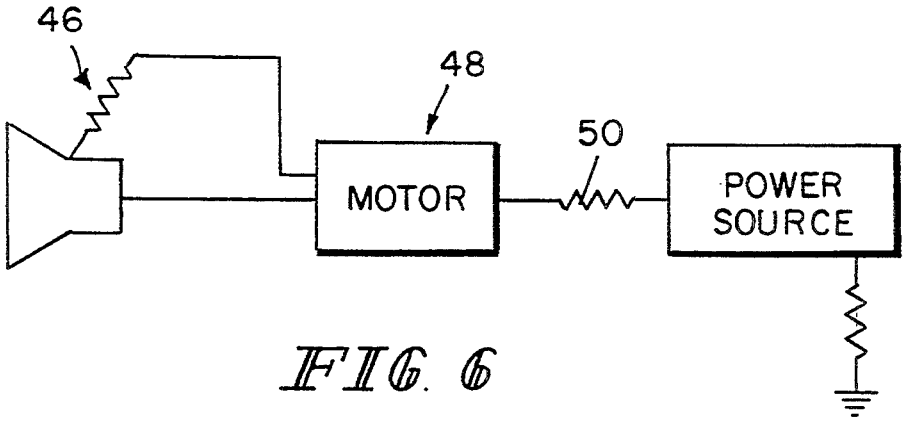
FIG. 6 illustrates a partly block and partly schematic diagram of a system constructed according to the present invention.

The configuration illustrated in FIG. 6 was constructed and tested with the variables noted in Table III.

TABLE III

| POWER SOURCE | $R_{50}$ | $R_{46}$ | DISPLAYED I(μA) | REQUESTED KV | ENERGY DISCHARGE (Bell Attached) | COMMENTS |
|---|---|---|---|---|---|---|
| Rans-Pak 100 | 250MΩ | 10MΩ | 60 | 100 | GOOD | |
| Rans-Pak 100 | 120MΩ | 10MΩ | — | 100 | GOOD | RP100 TRIPS EASILY |
| Rans-Pak 100 | 0Ω | 10MΩ | 70 | 100 | NONE | RP100 TRIPS PREMATURELY |
| Rans-Pak 100 | 0Ω | 50MΩ | — | 100 | NONE | RP100 TRIPS |

TABLE III-continued

| POWER SOURCE | $R_{50}$ | $R_{46}$ | DISPLAYED I(μA) | REQUESTED KV | ENERGY DISCHARGE (Bell Attached) | COMMENTS |
|---|---|---|---|---|---|---|
| Rans-Pak 100 | 0Ω | 50MΩ | — | 70 | GOOD | PREMATURELY RP100 TRIPS EASILY |
| 18100 | 0Ω | 50MΩ | — | 40 | ARCING | VERY SUSCEPTIBLE TO ARCING |
| 18100 | 250MΩ | 50MΩ | 105 | 100 | GOOD | |

It was noted that the electrode resistor 46 can be kept relatively small, for example, 10 MΩ–50 MΩ, in conjunction with a larger motor 48 resistance 50.

The prior art such as, for example, U.S. Pat. No. 4,887,720, does not efficiently and effectively address the problems of transferring the high voltage to the outside surface of the resinous bell without contacting the bell surface, and of controlling the stored energy in the metal bell rotator so that the likelihood of a hazardous electrical discharge from the motor shaft will be minimized even if the bell is not in place when the high voltage is on. Instead, prior art of this type employs very high fixed resistance, on the order of 1 GΩ or more, to achieve safety. Other rotary atomizers, of the type described in, for example, U.S. Pat. Nos. 3,021,077, 2,926,106, 2,989,241 and 3,048,498, use direct contact to transfer the voltage to the bell surface.

U.S. Pat. No. 3,826,425 relates to a rotating resistive disk. This reference describes a non-contact commutator which surrounds the motor shaft, but the U.S. Pat. No. 3,826,425 system includes an electrically non-conductive, for example, resin or filled resin, shaft, and the commutator transfers the voltage to the rotating disk.

The regulated power source 22, such as the Rans-Pak 100 power supply; limited amount of fixed resistance, for example, less than about 500 MΩ; thin film commutator and a resistive feed tube tip together reduce the likelihood of an incendive arc from the shaft or housing in the event the bell is not in place when the high voltage is energized.

Referring to FIG. 7, a thin film, high voltage commutator 60 comprises a semiconductive film which coats the inner, typically right circular cylindrical surface 62 of the typically resinous shaping air housing 64 which surrounds the rotating bell 66. Coating 60 is coupled to the high voltage circuit 70 through a conductor 72 of limited capacitance. The commutating film 60 is constructed according to any of a variety of methods, such as by applying a semiconductive coating comprising a mixture of carbon and varnish of the type described in U.S. Pat. No. 3,021,077 to the inner surface 62 and then curing the applied coating 60 by heat or chemical reaction. Another suitable method would be to provide the shaping air housing with a cylindrical insert comprising a semiconductive resin or filled resin material.

Further according to this aspect of the invention, the tip 76 of the resinous feed tube 78 for the coating material is coated 80 with a semiconductive material. The coating 80 extends beyond the tip 82 of the metal motor 84 shaft 86. Energy is stored in the shaft 86 and motor 84 by virtue of their proximity to the high voltage on commutator film 60, and the practical limitation that motor 84 and shaft 86 cannot be at ground. The motor shaft 86 charges the tip 76 of the resinous feed tube 78. Since the tip 76 of the feed tube 78 is protruding and is semiconductive, with limited stored energy, it dissipates the energy from the motor 84 and shaft 86 when approached by a grounded object.

Tests conducted on the device illustrated in FIG. 7 establish that it provides efficient transfer of the high voltage from the thin film commutator 60 to the outer surface 90 of the resinous bell 66. This results in high transfer efficiency and safe operation. This configuration passes the standard FM test for non-incendive listed electrostatic equipment. These tests also establish that the device illustrated in FIG. 7 is capable of achieving effective control of the discharge energy from the metal motor 84 and shaft 86. According to standard test procedures used by FM and other safety testing agencies, a motor assembly incorporating a resinous bell having the general configuration illustrated in U.S. Pat. No. 4,148,932, for example, would not be tested without the resinous bell in place. However, it is believed to be highly desirable, in order to offer the greatest protection to users of this equipment, to safety test the assembly with the bell 66 removed, exposing the tip 82 of the metal shaft 86. When so tested, the assembly illustrated in FIG. 7 passes the standard safety test.

FIGS. 8*a–d* illustrate a partly sectional front elevational view, a sectional side elevational view, a sectional view of a detail, and a greatly enlarged and fragmentary sectional side elevational view, respectively, of a resinous bell constructed according to the present invention. Bell 100 can be constructed from any suitable resin or filled resin such as, for example, Victrex 450GL30, 30% glass-filled PEEK available from ICI Americas (P.O. Box 6, Wilmington, Del. 19899), Ultem® filled or unfilled PEI available from General Electric (One Plastics Ave., Pittsfield, Mass. 01201), Valox #5433 33% glass filled PBT available from GE, or filled or unfilled Torlon PAI available from Amoco (386 Grove Street, Ridgefield, Conn. 06877). The outside surface of bell 100 is coated with a semiconductive coating 101 of any of the types previously described. A labyrinth-type region 102 of bell 100 extends into the inner portion of the metal bell rotator motor shaft 104. This labyrinth 102 creates a longer path for high voltage to travel from the metal shaft 104 to the bell splash plate 106. The bell splash plate 106 has several small grooves 108 which provide passages to the face 110 of the bell 100. Coating material flows through grooves 108 on its way from the feed tube 112 to the discharge zone 114. In other words, bell 100 is designed to prevent hazardous discharges from the metal shaft 104, through the small grooves 108 in the splash plate 106 to ground. It may be recalled that FIG. 7 illustrates a method of reducing the likelihood of hazardous electrical discharges by coating the end 76 of the resinous feed tube 78 with a semiconductive, for example, carbon-base, coating. Although the bell 100 illustrated in FIGS. 8*a–d* overcomes the need for coating the end of the feed tube 112 with semiconductive material to reduce the likelihood of such hazardous discharges through the splash plate grooves 108, the semiconductively-coated feed tube 78 of FIG. 7 can be employed with the bell 100 of FIGS. 8*a–d* to reduce the likelihood of hazardous discharges from the motor shaft 104 when the electrostatic power supply is turned on while the bell 100 of FIGS. 8*a–d* is removed from the shaft 104.

EXAMPLE IV

Indirect Charging With Commutating Shaping Air Ring Coating

The configuration illustrated in FIG. 9 with the charging technique illustrated in FIG. 7 was tested with the variables noted in Table IV. A DeVilbiss Ransburg type EPS554 electrostatic power supply 120 was used in Example IV. Supply 120 is available from DeVilbiss Ransburg Industrial Liquid Systems, 320 Phillips Avenue, Toledo, Ohio 43612. The resistance 124 between the power supply 120 and ground was 5 GΩ. The resistance 126 between the power source 120 and the semiconductive commutating coating on the inside of the shaping air cap (see FIG. 7), the effective resistance 128 between the commutating coating and the surface 130 of the bell 122, and the effective resistance 132 to the discharge zone 134 of the bell 122 were all varied as noted in Table IV.

The minimum series resistance 124 in these tests which passed the ignition test was between 150 MΩ and 200 MΩ with a bell 122 and shaping air commutator. A 250 MΩ resistor 124 was used for the remaining tests.

The labyrinth 102 type bell of FIGS. 8*a–d* provided protection against ignition to the metal motor shaft in every test with the exception of an uncoated bell 122 with no splash plate 106. No non-labyrinth bell 122 passed the ignition test. The outer end of the paint feed tube does not need to be coated when using a labyrinth-type bell.

Ignition occurred from the rear of the commutating coating on the inside of the shaping air ring. This indicates that the minimum resistance is between 2 MΩ and 20 MΩ. The resistance may be critical due to the large coated surface area and surface geometry.

Although carbon tracking occurred in the discharge zones of bells while probing within approximately 0.2 inch (about 5.1 mm) of surfaces, such tracking did not result in ignition.

Shielded high voltage cables did not increase stored system energy sufficiently to promote ignition while using 200 MΩ series resistance 124.

A variety of methods were pursued for imparting conductivity to the bell. To function effectively, a material must be capable of distributing charge uniformly throughout the discharge zone, and exhibit low enough capacitance to pass safety specifications. The materials tested include carbon fiber-filled polymers, intrinsically conductive polymers, and $TiO_x$ deposition.

TABLE IV

| $R_{132}$ | $R_{128}$ | $R_{126}$ | Labyrinth 102 of FIGS. 8a–d | Splash Plate 106 of FIGS. 8a–d | End of Feed Tube Coated With Semiconductive Coating | Ignition Test Results | COMMENTS |
|---|---|---|---|---|---|---|---|
| 23MΩ | 20MΩ | 250MΩ | Yes | Yes | Yes | Passed | Carbon tracking on inner edge of bell |
| 23MΩ | 20MΩ | 200MΩ | Yes | Yes | Yes | Passed | Carbon tracking on inner edge of bell |
| 23MΩ | 20MΩ | 150MΩ | Yes | Yes | Yes | Failed | |
| 23MΩ | 20MΩ | 150MΩ | Yes | Yes | Yes | Failed | |
| 23MΩ | 20MΩ | 200MΩ | Yes | Yes | Yes | Passed | Carbon tracking |
| 23MΩ | 20MΩ | 200MΩ | Yes | Yes | Yes | Passed | Carbon tracking |
| 23MΩ | 20MΩ | 250MΩ | Yes | Yes | No | Passed | No visible corona or discharges through splash plate |
| 23MΩ | 20MΩ | 250MΩ | Yes | No | No | Passed | No visible corona or discharges to shaft |
| ∞ | 20MΩ | 250MΩ | Yes | No | No | Failed at 2 min. | No carbon tracking |
| ∞ | 20MΩ | 250MΩ | Yes | Yes | No | Passed | |
| 11MΩ | 20MΩ | 250MΩ | Yes | Yes | No | Passed | Carbon tracking on inner edge of bell |
| 5MΩ | 20MΩ | 250MΩ | No | Yes | No | Failed at 70 sec. | Ignition while probing splash plate 106 |
| 11MΩ | 2MΩ | 250MΩ | Yes | Yes | No | Failed at 10 sec. | Ignition while probing rear of shaping air cap |
| 5MΩ | 20MΩ | 250MΩ | No | Yes | Yes | Failed at 35 sec. | Ignition while probing splash plate 106 |
| 30MΩ | 20MΩ | 250MΩ | No | Yes | Yes | Failed at 40 sec. | Ignition while probing splash plate 106 |

A conductive carbon fiber loaded, polyester (polybutylene terephthalate—PBT) resin from LNP (412 King Street, Malvern, Pa. 19355) was molded into bells and tested for ignition. This material failed because it did not pass FM testing, and because of the inconsistency in charge distribution at the bell edge from bell to bell. This inconsistency is due to the fact that the conductivity in the region of interest ($10^5$–$10^7$ ohms cm), is very dependent on the amount of carbon fiber present. A few percent variation in the amount of carbon fiber in the formulation changes the resistance value dramatically. The length of the carbon fibers also has a considerable effect on conductivity.

Intrinsically conductive polymers, such as polyaniline, were pursued since they provide conductivity on the molecular level (M. Kanatzidis, "Conductive Polymers," Chemical and Engineering News, Dec. 3, 1990). This attribute offers more consistent resistivity values than carbon fiber-filled systems. Injection molding trials were run on three resins supplied by Americhem Inc., of Cuyahoga Falls, Ohio (225 Broadway East, Cuyahoga Falls, Ohio 44221). These resins had resistivities of $10^3$, $10^5$, and $10^9$ ohm cm. Tests were run on bells made from these resins, and on nonconductive resin bells with thin layers of these resins molded onto their outside surfaces. This latter approach was deemed necessary in order to give the bells the structural strength required to withstand rotational stresses. These resins are sensitive to temperatures used in injection molding. Several molding trials were performed using the lowest melt temperature possible, and the bells exhibited losses in conductivity as a result of this sensitivity to process temperature. A liquid polyaniline-based coating was also applied to bells, but this coating was very irregular, and so was its resistivity.

Another intrinsically conductive polymer based on polypyrrole was obtained from Milliken Chemical Co. of Spartansburg, S.C. (P.O. Box 1927, M-405, Spartansburg, S.C. 29304-1927). This polymer was applied to Allied Signal Capron 8260 nylon bells (PTL Bldg., P.O. Box 2332R, Morristown, N.J. 07960). The process used is typically performed on continuous fibers to make them conductive, but Milliken's attempt to coat bells was successful. The best bell, which passed ignition tests, had a resistivity value of $2\times10^5$ ohm cm. Additionally, these bells were subjected to 100% humidity conditions for several days and then retested for ignition. The fact that they also passed indicates that moisturization of the nylon, even from saturation, does not contribute to ignition failures. This process is therefore considered a suitable alternative to the previously described carbon coating.

What is claimed is:

1. An electrostatic coating system comprising, in combination, a rotary atomizer comprising an inside surface onto which a coating material is deposited, an opposite outside surface and a discharge zone adjacent the rotary atomizer's inside and outside surfaces, coating material being discharged from the discharge zone, first means for rotating the rotary atomizer, a housing for substantially surrounding and housing the rotary atomizer except for a region of the rotary atomizer adjacent and including the discharge zone, the housing including an inside surface, an outside surface and an opening adjacent the inside and outside surfaces of the housing, the inside surface of the housing and the outside surface of the rotary atomizer both being treated so as to be electrically non-insulative, and second means for maintaining an electrostatic potential difference across the electrically non-insulative inside surface of the housing and an article to be coated by material atomized by the rotary atomizer.

2. The system of claim 1 wherein the second means comprises a high-magnitude potential source, and third means for coupling the high-magnitude potential source across the inside surface of the housing and the article to be coated.

3. The system of claim 2 wherein the third means has a resistance not greater than 500 MΩ.

4. The system of claim 3 wherein the third means has a resistance not greater than 250 MΩ.

5. The system of claim 2 wherein the resistance between the second means and the discharge zone is not greater than 500 MΩ.

6. The system of claim 5 wherein the resistance between the second means and the discharge zone is not greater than 250 MΩ.

7. The system of claim 1 wherein the treatment comprises a non-insulative coating applied to the inside surface of the housing and the outside surface of the rotary atomizer.

8. The system of claim 7 wherein the non-insulative coating comprises non-insulative particles in a resin material.

9. The system of claim 7 wherein the non-insulative coating comprises a metallic film.

10. The system of claim 7 wherein the non-insulative coating comprises a film mixture of a semiconductor and a metal.

11. The system of claim 1 wherein the treatment comprises irradiating the outside surface of the rotary atomizer to render it electrically non-insulative.

12. The system of claim 7, 8, 9, 10 or 11 wherein the resistance between the second means and the discharge zone is not greater than 500 MΩ.

13. The system of claim 12 wherein the resistance between the second means and the discharge zone is not greater than 250 MΩ.

14. The system of claim 1, 2, 3, 4, 5, 6, 7, 8, 9, 10 or 11 wherein the rotary atomizer and the housing are constructed from electrically non-conductive resinous materials.

15. The system of claim 14 wherein the rotary atomizer is constructed from polyetheretherketone (PEEK).

16. The system of claim 15 wherein the rotary atomizer is constructed from PEEK with a filler.

17. The system of claim 14 wherein the rotary atomizer is constructed from polyetherimide (PEI).

18. The system of claim 17 wherein the rotary atomizer is constructed from PEI with a filler.

19. The system of claim 14 wherein the rotary atomizer is constructed from polyester.

20. The system of claim 19 wherein the polyester is polybutylene terephthalate (PBT).

21. The system of claim 20 wherein the rotary atomizer is constructed from PBT with a filler.

22. The system of claim 14 wherein the rotary atomizer is constructed from polyamide-imide (PAI).

23. The system of claim 22 wherein the rotary atomizer is constructed from PAI with a filler.

* * * * *